United States Patent [19]

Gruber

[11] Patent Number: 5,002,258

[45] Date of Patent: Mar. 26, 1991

[54] JACK AND COMPONENTS THEREFOR

[75] Inventor: Rudolf Gruber, Claremont, Canada

[73] Assignee: Multimatic Inc., Markham, Canada

[21] Appl. No.: 568,046

[22] Filed: Aug. 16, 1990

Related U.S. Application Data

[63] Continuation of Ser. No. 307,490, Feb. 7, 1989, abandoned.

[30] Foreign Application Priority Data

Feb. 11, 1988 [CA] Canada ..... 558752

[51] Int. Cl.[5] ..... B66F 3/08

[52] U.S. Cl. ..... 254/126

[58] Field of Search ..... 254/122, 126, 98; 411/4, 3, 5, 2, 925, 938, 972; 81/121.1

[56] References Cited

U.S. PATENT DOCUMENTS

| | | | |
|---|---|---|---|
| Re. 30,640 | 6/1981 | Keilholz . | |
| 3,317,187 | 5/1967 | Steppor | 254/126 |
| 3,989,225 | 11/1976 | Keilholz . | |
| 4,055,329 | 10/1977 | Hammond . | |
| 4,093,182 | 6/1978 | Rutenbeck . | |
| 4,448,392 | 5/1984 | Ladewski . | |
| 4,653,727 | 3/1987 | Chang et al. . | |
| 4,802,653 | 2/1989 | Engel | 254/126 |

FOREIGN PATENT DOCUMENTS

| | | | |
|---|---|---|---|
| 1199626 | 1/1986 | Canada . | |
| 2352400 | 10/1973 | Fed. Rep. of Germany | 411/2 |
| 2902579 | 7/1980 | Fed. Rep. of Germany . | |
| 3033956 | 6/1982 | Fed. Rep. of Germany . | |
| 2132729 | 7/1984 | United Kingdom | 411/2 |
| 2182308 | 5/1987 | United Kingdom . | |
| 02060 | 4/1986 | World Int. Prop. O. . | |
| 06707 | 11/1986 | World Int. Prop. O. . | |

*Primary Examiner*—Robert C. Watson

*Attorney, Agent, or Firm*—Neil H. Hughes; Ivor M. Hughes

[57] ABSTRACT

An improved jack with overload prevention including a lead screw having a driven end and an upstanding integral boss proximate the driven end, the driven end comprising a body abutting the upstanding boss and including an opening therethrough for receiving the end of the lead screw, the body carrying slots, grooves or recesses radiating from the opening and being in communication with the opening and carrying material from the lead screw displaced into the grooves thereby securing the body to the lead screw.

13 Claims, 1 Drawing Sheet

JACK AND COMPONENTS THEREFOR

This application is a continuation of Ser. No. 07/307,990 filed Feb. 7, 1989 now abandoned.

FIELD OF INVENTION

This invention relates to improved jacks suitable for use for elevating vehicles and components and constituents for such jacks.

BACKGROUND OF INVENTION

Scissors jacks are known in the art. In these jacks, ends of scissors arms are joined by a continuous lead screw. The lead screw is secured in a non-rotatable threaded sleeve secured to one scissors arm and passes freely through a non-rotatable body secured to the other scissors arm. At its other end (drive end), the lead screw is enlarged for example by a hex-nut united to its end, for being driven.

The scissors arms are jacked up and down (for elevating and lowering the body of the vehicle) by rotating the lead screw by driving the hex-nut.

For safety purposes, the jack must stay in its elevated position even if the enlarged end shears off or breaks off. Preferably that end shears off at predetermined input torque to ensure the safety of the jack.

It is therefore an object of the invention to provide an improved jack and constituents and components therefor.

It is a further object of the invention to provide a jack comprising a lead screw carrying an improved structure which may be caused to shear at a predetermined torque.

It is a further object of the invention to provide improved components which are easier to assemble and use to assemble the jack.

Further and other objects of the invention will be realized by those skilled in the art from the following summary of the invention and detailed description of embodiments thereof.

SUMMARY OF INVENTION

According to one aspect of the invention, there is provided an improved jack (for example scissors jack) comprising a lead screw having a driven end and an upstanding integral flange a base proximate the driven end, the jack having disposed at the driven end adjacent and abutting the upstanding integral boss securing means having an opening therethrough for passage of the lead screw and being interconnected with the arms and the engaging member to prevent movement of the securing means when the lead screw is driven. Preferably, the securing means is abutting planar plates. The driven end comprising a body comprising an opening (a central longitudinally extending opening for receiving the end of the lead screw therethrough and slots or grooves or recesses radiating from the opening are provided in the body and being in communication with the opening and material from the lead screw displaced into the slots or grooves (as for example by staking) thereby securing the body to the lead screw.

In one embodiment the body comprises a slotted hexagon nut or "castellated" hex-nut there being no thread in the bore through the nut for example manufactured by SpaeNaur, Kitchener, Ontario, Canada, style Din 93S and ANSI B18.2.2.

According to another aspect of the invention, there is provided an improved jack (preferably scissors jack) comprising a pair of arms (for example one arm from a pair of scissors arms of a scissors jack and the other extending from proximate the end of the arm from the pair of scissors arms) secured to a pair of non-rotatable abutting planar plates carrying aligned longitudinally directed openings therethrough (one opening through each plate) (for the passage of a longitudinally extending lead screw therethrough), each plate carrying laterally extending projections from each side, the side of each projection directed toward the other plate being generally flat and extending in the same plane as the planar plate and the other side being curved to form a segment of a circle (in cross-section being a portion of a cylinder for example being a semi-circular portion at a cylinder having Diameter "D"), the projections when the planar plates abut presenting a circular formation (preferably a cylinder) having Diameter "D" the ends of the projections remote the plates being enlarged, the end of each arm proximate the other arm carrying a laterally directed circular opening (having the predetermined Diameter of the abutting projections) for carrying the laterally extending projections of the plates, the openings in communication with slots entirely through the arms the slots being smaller than the circular abutting projections and the enlarged ends, but being larger than the cross-section of each projection to permit the projections one at a time to be moved through the slots into the openings, the slots of one arm opening in one direction (for example upwardly) when the arm is mounted for use and the slots of the other arm opening in another direction [for example in the opposite direction (in one embodiment, downwardly)] when the arm is mounted for use whereby after the projections of one plate are inserted through the slots and the projections of the other plate inserted through the slots and the plates permitted to abut with the flat faces of the projections abutting; and with the arms mounted for use, the slots of one arm open in one direction and the slots of the other arm open in the other direction.

For ease of mounting the arms, the slots of both arms are positioned for mounting the plates to open in the same direction and the projections of the pair of abutting plates inserted one plate at a time and then one of the arms is rotated to its position for use with the slots opening in one embodiment, in opposite directions.

In one embodiment, a scissors jack is provided comprising a lead screw a pair of scissors arms, and another arm, one of the scissors arms and the other arm secured to the projections of the abutting plates in the manner described above, the lead screw carrying the slotted or grooved body secured to the driven end of the lead screw in the manner described above. In this way if the driving force on the body (e.g. hex-nut) exceeds a predetermined torque, the body will shear. However because the upstanding integral flange of the lead screw abuts the plates, the plates cannot move and the jack remains in that position.

According to another aspect of the invention an improved scissors jack is provided comprising an improved jack comprising a pair of non-rotatable abutting planar plates, and a pair of arms, the ends of which arms are secured to the pair of non-rotatable abutting planar plates, the abutting plates comprising longitudinally directed openings therethrough (one opening through each plate) for the passage of a longitudinally extending lead screw therethrough, each plate carrying laterally extending projections from each side, the side of each projection directed toward the other plate being generally flat and extending in the same plane as the planar plate and the other side being curved to present a segment of a circle (in cross-section being a portion of a cylinder) the projections when the planar plates abut presenting a circular formation having a diameter "D", the ends of the projections remote the plates being enlarged, the end of each arm proximate the other arm carrying laterally directed circular openings having the same diameter "D" as the abutting projections for carrying the laterally extending projections of the plates, the openings being in communication with slots entirely through the arms, the slots being smaller than the circular abutting projections and the enlarged ends, but being larger than the cross-section of each projection to permit the projections one at a time to be moved through the slots into the openings, the slots of one arm opening in one direction when the arm is mounted for use and the slots of the other arm opening in another direction when that arm is mounted for use whereby after the projections of one plate are inserted through the slots and the projections of the other plate inserted through the slots and the plates permitted to abut with the flat faces of the projections abutting and with the arms mounted for use, the slots of one arm open in one direction and the slots of the other arm open in the other direction.

BRIEF DESCRIPTION OF THE DRAWINGS

The invention will now be illustrated with reference to the following drawings in which.

DETAILED DESCRIPTION OF EMBODIMENT

Figures 1, 2, 3, 4:
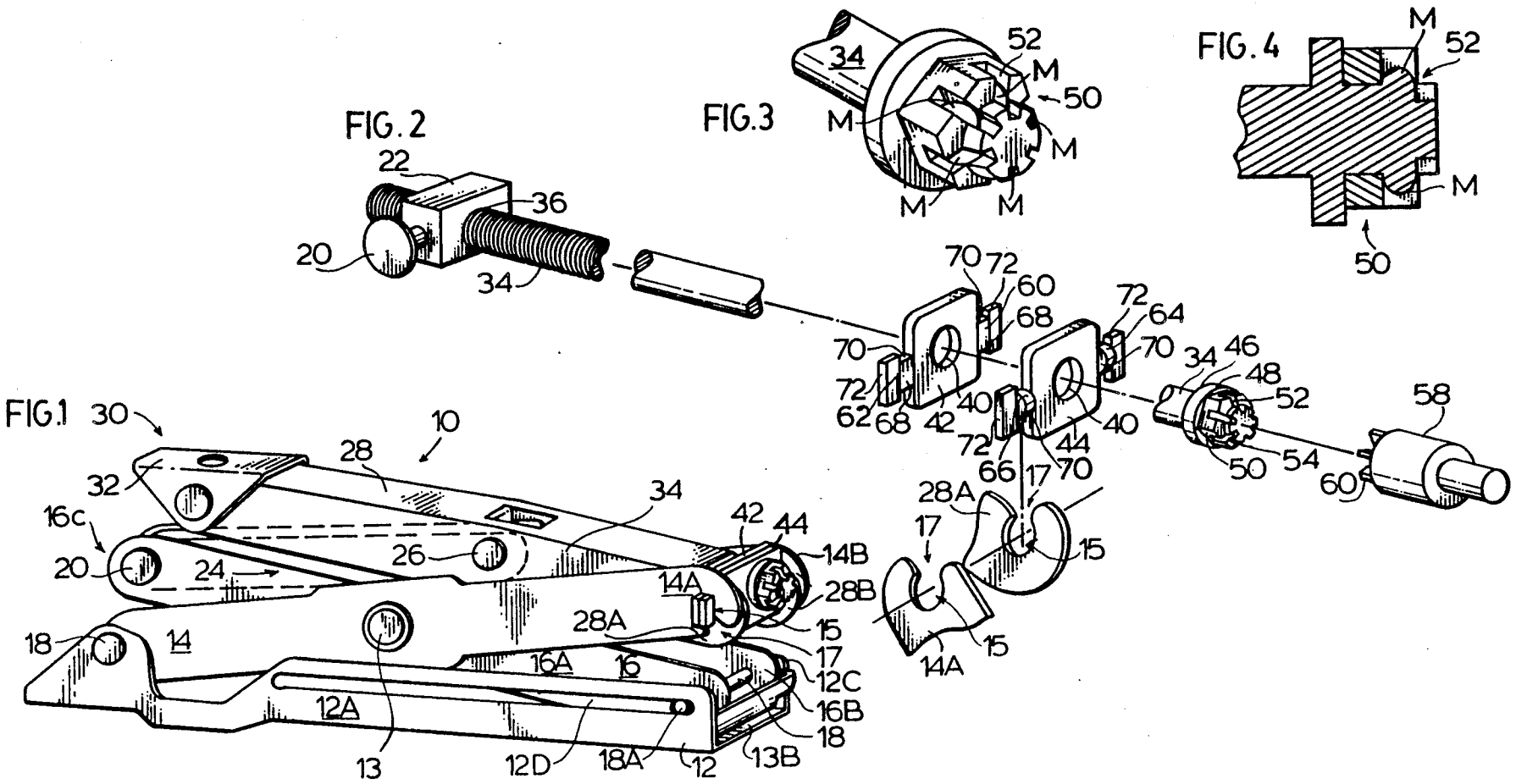
FIG. 1 is a perspective view of a scissors jack constructed according to an embodiment of the invention.
FIG. 2 is an exploded perspective view of some of the components used in the assembly of the scissors jack in FIG. 1 illustrating steps in the assembly of the portions of the jack.
FIG. 3 is an enlarged perspective view of one of the components in FIG. 2.
FIG. 4 is a cross-sectional view of the component shown in FIG. 3.

With reference to FIG. 1, there is shown scissors jack 10 comprising generally rectangular base 12 (having four connected members three of which are 12A; 12B and 12C) supporting scissor arms 14 and 16 joined together by pin 13. Arm 14 pivots on pin 18 extending through members 12A and 12C of base 12. Arm 14 comprises two spaced planar portions 14A and 14B connected by connector (not shown) each carrying circular laterally directed circular apertures 15 in communication with slot 17 opening through each portion 14A and 14B. Slot 17 diverges becoming broader from opening 15.

Arm 16 is made up of two planar portions 16A and 16B joined together and carries laterally extending pin 18, the ends of which (for example 18A) for riding in longitudinally extending slot 12D is base portions 12A and 12C. Arm 16 is pinned by pin 20 at end 16C to non-rotatable threaded sleeve 22 (see FIG. 2). Arm 24 (in dotted line in FIG. 1) is also secured to pin 20 and is secured by pin 26 to upper arm 28. The end 30 of arm 28 carries member 32 for placing under a vehicle (not shown) for lifting the vehicle as required. Lead screw 34 (seen in FIG. 1 as angularly striped portion) passes through threaded base 36 of threaded sleeve 22. Arm 28 also carries two portions 28A and 28B each carrying a like aperture 15 and slot 17 as arm 14. However when mounted for use, each slot 17 of each portion 14A and 14B is directed downwardly and each slot 17 of portions 28A and 28B is directed upwardly. Lead screw 34 carrying integral boss. 48 (see FIG. 4) extends angularly rearwardly (see FIG. 1) passing through circular apertures 40 in non-rotatable abutting planar plates 42 and 44 and is staked at end 46 to castellated hex-nut 50 carrying radially outwardly extending grooves or slots 52. One groove or slot 52 is provided opening through each of the six sides 54 of nut 50.

Hex-nut 50 is staked to the end of lead screw 34 by tool 58 which is applied to the end of lead screw 34 and displaces lead screw material "M" into the slots or grooves 52 which material "M" is moved into the slots and grooves 52 by raised projections 60 on tool 58 (having the same pattern as the slots or grooves 52) and carries a forwardly projecting annular portion for first engaging lead screw 34 to displace lead screw material. (See also FIGS. 3 and 4.)

Each of plates 42 and 44 abut in use (see FIG. 1) and carry laterally extending projections 60 and 62, and 64 and 66. Each of the projections carries flat abutting faces 68 and semi-cylindrical curved portions 70. The abutment of plates 42 and 44, together presents cylindrical projections having the same diameter "D" as the Diameter of laterally directed openings 15. Blocks 72 are provided on the end of each projection 60, 62, 64 and 66. Each slot 17 is a size to permit one projection 60, 62, 64 and 66 to be inserted through slot 17 into opening 15 at anytime. Slot 17 cannot receive two projections simultaneously. However once one projection is inserted in opening 15, the second projection from the other plate is inserted through slot 17 into aperture 15. Blocks 72 will not pass through slots 17.

For assembly of jack 10, both arms 14 and 16 are oriented with both slots 17 oriented to open upwardly. Projection 66 of plate 44 is inserted through slot 17 and positioned with curved surface 70 positioned to engage the circular wall portion defining opening 15. Then plate 44 is positioned with projection 62 of plate 42 positioned in opening 15 with curved portion 70 abutting the circular wall portion defining opening 15. Likewise the other projections 64 and 60 are secured. Thereafter arm 14 is rotated to the position shown in FIG. 1 so that slots 17 of arm 28 and arm 14 open in opposite directions.

In use, an operating driving tool (not shown) is applied to hex-nut 50 of lead screw 34 for rotating hex-nut 50 and thus lead screw 34. As lead screw 34 is rotated, non-rotatable sleeve 22 is carried to move along lead screw 34 shortening the space between hex-nut 50 and sleeve 22 thereby causing arms 14 and 16 to be raised and arm 24 to be lifted elevating arm 28 and thus member 32.

Because the slots 17 of arms 14 and 28 open in opposite directions, plates 42 and 44 are securely held by the arms 14 and 28. When the applied torque on hex-nut 50 exceeds a predetermined limit (caused by a driving tool applied to hex-nut 50), dependent on the amount of and kind of material displaced into the hex-nut slots or grooves by staking the material from the lead screw, the hex-nut will shear or break and the lead screw 34 cannot be rotated. However because integral raised boss 48 of lead screw 34 continues to engage abutting plates 42 and 44 and because sleeve 22 still engages lead screw 34 by the meshing of the threads, the jack remains safely elevated.

As many changes can be made to the embodiment without departing from the scope of the invention, it is intended that all material contained herein be interpreted as illustrative of the invention and not in a limiting sense.

The embodiments of the invention in which an exclusive property or privilege is claimed are as follows:

1. An improved jack for lifting a body, comprising a base, supporting arms carried by the base, an engaging member carried by the supporting arms for engaging the body to be lifted, at least two of the supporting arms carrying a lead screw having a driven end and an upstanding integral boss proximate the driven end, the jack having disposed at the driven end adjacent and abutting the upstanding integral boss securing means having an opening therethrough for passage of the lead screw and being interconnected with the arms and the engaging member to prevent movement of the securing means when the lead screw is driven, the driven end comprising a body abutting the upstanding boss and including an opening therethrough for receiving the end of the lead screw, the body carrying means radiating from the opening and being in communication with the opening and carrying material from the lead screw displaced into the means thereby securing the body to the lead screw, whereby when a driving force on the body exceeds a predetermined torque the body will shear from the lead screw, the upstanding integral boss of the lead screw abutting the securing means retaining the jack in position.

2. The improved jack of claim 1, wherein the lead screw is secured to the body by staking.

3. The improved jack of claim 1 or 2, wherein the body comprises a slotted hex-nut.

4. The improved jack of claim 1 or 2, wherein the body comprises a castellated hex-nut.

5. The improved jack of claim 1 or 2, wherein the jack is a scissors jack and at least two supporting arms are scissors arms connected together.

6. An improved jack comprising a pair of non-rotatable abutting planar plates, and a pair of arms, the ends of which arms are secured to the pair of non-rotatable abutting planar plates, the abutting plates comprising longitudinally directed openings therethrough, for the passage of a longitudinally extending lead screw therethrough, each plate carrying laterally extending projections from each side, the side of each projection directed toward the other plate being generally flat and extending in the same plane as the planar plate and the other side being curved to present a segment of a circle, the projections when the planar plates abut presenting a circular formation having a diameter "D", the ends of the projections remote the plates being enlarged, the end of each arm proximate the other arm carrying laterally directed circular openings having the same diameter "D" as the abutting projections for carrying the laterally extending projections of the plates, the openings being in communication with slots entirely through the arms, the slots being smaller than the circular abutting projections and the enlarged ends, but being larger than the cross-section of each projection to permit the projections one at a time to be moved through the slots into the openings, the slots of one arm opening in one direction when the arm is mounted for use and the slots of the other arm opening in another direction when that arm is mounted for use whereby after the projections of one plate are inserted through the slots and the projections of the other plate inserted through the slots and the plates permitted to abut with the flat faces of the projections abutting and with the arms mounted for use, the slots of one arm open in one direction and the slots of the other arm open in the other direction.

7. The jack of claim 6, wherein the jack is a scissors jack and one arm is from a pair of scissors arms of a scissors jack and the other arm extends from proximate the end of the arm from the pair of scissors arm and is connected to the portion engaging the vehicle.

8. The jack of claim 6, wherein the two directions are opposite one another when the arms are mounted for use.

9. The jack of claim 7, wherein the two directions are opposite one another when the arms are mounted for use.

10. The jack of claim 6 or 7, wherein the directions of the slots are upwardly and downwardly when the arms are mounted for use.

11. An improved scissors jack comprising a longitudinally extending lead screw having a driven end and an upstanding integral boss proximate the driven end, a pair of scissors arms pivoted about their middle for scissors motion, the lower ends of the arms being secured to a base, the other end of one of the scissors arms being secured to a non-rotatable threaded sleeve, the sleeve for receiving and securing the lead screw, the other arm secured to a pair of abutting planar plates having longitudinally extending openings through the plates through which the lead screw passes, the said planar plates also securing another arm which arm is operable by the scissors arms and lead screw for lifting a vehicle, the lead screw securing a body abutting the upstanding boss and the body including an opening, a longitudinally extending opening therethrough for receiving the end of the lead screw, the body carrying means radiating from the opening and being in communication with the opening and carrying material from the lead screw displaced into the means thereby securing the body to the lead screw, the abutting plates each carrying laterally extending projections from each side of each plate, the side of each projection directed toward the other plate being generally flat and extending in the same plane as the planar plate and the other side being curved to present a segment of a circle, in cross-section being a portion of a cylinder, the projections when the planar plates abut presenting a circular formation having a diameter "D", the ends of the projections remote the plates being enlarged, the end of each arm proximate the other arm carrying laterally directed circular openings having the same diameter "D" as the abutting projections for carrying the laterally extending projections of the plates, the openings being in communication with slots entirely through the arms, the slots being smaller than the circular abutting projections and the enlarged ends, but being larger than the cross-section of each projection to permit the projections one at a time to be moved through the slots into the openings, the slots of one arm opening in one direction when the arm is mounted for use and the slots of the other arm opening in another direction when that arm is mounted for use whereby after the projections of one plate are inserted through the slots and the projections of the other plate inserted through the slots and the plates permitted to abut with the flat faces of the projections abutting and with the arms mounted for use, the slots of one arm open in one direction and the slots of the other arm open in the other direction.

12. The scissors jack of claim 11, wherein the two directions are opposite one another when the arms are mounted for use.

13. The scissors jack of claim 11, wherein the directions of the slots are upwardly and downwardly when the arms are mounted for use.

* * * * *